US005574431A

United States Patent [19]

McKeown et al.

[11] Patent Number: 5,574,431

[45] Date of Patent: Nov. 12, 1996

[54] DEACTIVATEABLE SECURITY TAG

[75] Inventors: Thomas J. McKeown, Pensauken; Gary T. Mazoki, Sewell, both of N.J.

[73] Assignee: Checkpoint Systems, Inc., Thorofare, N.J.

[21] Appl. No.: 521,084

[22] Filed: Aug. 29, 1995

[51] Int. Cl.[6] ..... G08B 13/14

[52] U.S. Cl. ..... 340/572; 340/693

[58] Field of Search ..... 340/572, 693

[56] References Cited

U.S. PATENT DOCUMENTS

| | | | |
|---|---|---|---|
| 3,624,631 | 11/1971 | Chomet et al. | 340/280 |
| 3,810,147 | 5/1974 | Lichtblau | 340/280 |
| 3,863,244 | 1/1975 | Lichtblau | 340/280 |
| 3,913,219 | 10/1975 | Lichtblau | 29/592 |
| 4,021,705 | 5/1977 | Lichtblau | 361/402 |
| 4,567,473 | 1/1986 | Lichtblau | 340/572 |
| 4,728,938 | 3/1988 | Kaltner | 340/572 |
| 5,012,225 | 4/1991 | Gill | 340/572 |
| 5,081,445 | 1/1992 | Gill et al. | 340/572 |
| 5,103,210 | 4/1992 | Rode et al. | 340/572 |
| 5,172,461 | 12/1992 | Pichl | 29/25.42 |
| 5,182,544 | 1/1993 | Aguilera et al. | 340/572 |
| 5,276,431 | 1/1994 | Piccoli et al. | 340/572 |
| 5,508,684 | 4/1996 | Becker | 340/572 |
| 5,512,738 | 4/1996 | Yuen | 340/541 |

*Primary Examiner*—Thomas Mullen
*Assistant Examiner*—Benjamin C. Lee
*Attorney, Agent, or Firm*—Pantich Schwarze Jacobs & Nadel, P.C.

[57] ABSTRACT

A security tag used with an electronic article surveillance system for detecting the presence of the tag within a surveilled area utilizing electromagnetic energy at a frequency within a predetermined detection frequency range includes a dielectric substrate having first and second opposing principle surfaces and a resonant circuit capable of resonating at a frequency within the predetermined detection frequency range. The resonant circuit includes an inductor formed at least in part on one of the principal surfaces of the substrate. A first perforation path formed of a series of spaced apart perforations extends along a line across the substrate and through at least a portion of the inductor such that a stress exerted on the tag breaks the tag and the inductor along the first perforation path, causing an open circuit condition which prevents the resonant circuit from resonating.

In use, the security tag is affixed to an article and the stress applied to the article is a result of normal or ordinary use of the article.

17 Claims, 2 Drawing Sheets

DEACTIVATEABLE SECURITY TAG

FIELD OF THE INVENTION

The present invention relates to security tags for use with electronic security systems for the detection of unauthorized removal of articles and, more particularly, to a resonant tag which is deactivateable.

BACKGROUND OF THE INVENTION

Electronic article security systems for detecting and preventing theft or unauthorized removal of articles or goods from retail establishments and/or other facilities, such as libraries, are well known and widely used. In general, such security systems employ a label or security tag which is affixed to, associated with, or otherwise secured to an article or item to be protected or its packaging. Security tags may take on many different sizes, shapes, and forms, depending on the particular type of security system in use, the type and size of the article, etc. In general, such security systems are employed for detecting the presence of an active security tag as the security tag (attached to the protected article) passes through a security or surveillance zone or passes by or near a security checkpoint or surveillance station.

Certain prior art security tags work primarily with radio frequency (RF) electromagnetic field disturbance sensing electronic security systems, such as, but not limited to those disclosed in U.S. Pat. No. 3,810,147 entitled "Electronic Security System", U.S. Pat. No. 3,863,244 entitled "Electronic Security System Having Improved Noise Discrimination", and U.S. Pat. No. 5,276,431 entitled "Security Tag For Use With Article Having Inherent Capacitance", and their commercially available implementations and counterparts. Such electronic security systems generally establish an electromagnetic field in a controlled area through which articles must pass when being removed from the controlled premises. A tag having a resonant circuit is attached to each article, and the presence of the resonant circuit in the controlled area is sensed by a receiving system to denote the unauthorized removal of an article. The resonant circuit can be deactivated, detuned, shielded, or removed by authorized personnel from any article authorized (i.e. purchased or checked out) to be removed from the premises, thereby permitting passage of the article through the controlled area without alarm activation.

Security tags can be affixed to or associated with the article being secured or protected in variety of manners. Removal of a tag which is affixed to an article can be difficult and time consuming and, in some cases, requires additional removal equipment and/or specialized training. Detuning the security tag, for instance, by covering it with a special shielding device such as a metallized sticker, is also time consuming and inefficient. Furthermore, both of these deactivation methods require the security tag to be identifiable and accessible, which prohibits the use of tags embedded within merchandise at undisclosed locations or tags concealed in or upon the packaging.

Systems are known for the remote electronic deactivation of a resonant tag circuit where the deactivated tag can remain with an article properly leaving the premises. Electronic deactivation of a resonant security tag involves changing or destroying the detection frequency resonance so that the security tag is no longer detected as an active security tag by the security system. There are many methods available for achieving electronic deactivation, such as the systems shown in U.S. Pat. Nos. 3,624,631 and 3,810,147, in which a fusible link in the resonant circuit is burned out by the application of energy higher than that employed for detection to either activate or deactivate the tuned circuit. Deactivation may also be accomplished by shorting the tag's resonant circuit. Such electronically deactivateable tags include a weak link created by forming a dimple in the tag which brings more closely together plates of a capacitor formed by the metallizations of two different parts of the tag's resonant circuit on opposite sides of the tag substrate, thereby allowing electrical breakdown at moderate power levels. Such a breakdown causes a short circuit between the two metallizations. This type of deactivateable tag can be conveniently deactivated at a checkout counter or other such location by being momentarily placed above or near a deactivation device which subjects the tag to electromagnetic energy at a power level sufficient to cause one or more components of the security tag's resonant circuit to either short circuit or open, depending upon the detailed structure of the tag.

The demand for tags which may be installed at the point of manufacture by the manufacturer, as opposed to at the point of sale by the retailer, has increased rapidly. As such, the use of such tags is a growing trend. Since such tags are easily hidden within an article, it is important to provide other and/or additional means and methods for deactivating such tags. Thus, there is a need to provide a security tag which can be deactivated by other means or methods. The present invention fulfills this need by providing a tag which includes a novel means for disabling the resonant circuit of the tag.

SUMMARY OF THE INVENTION

Briefly stated, the present invention comprises a security tag for use with an electronic security system having means for detecting the presence of a security tag within a surveilled area utilizing electromagnetic energy at a frequency within a predetermined detection frequency range. The security tag has a dielectric substrate with first and second opposing principal surfaces, at least one resonant circuit disposed on the substrate capable of resonating at a frequency within the predetermined detection frequency range, and stress concentrating means for concentrating a mechanical stress exerted on the tag to a predetermined area of the tag proximate to at least a portion of the resonant circuit for disabling the resonant circuit. Thus, a mechanical stress exerted on the tag breaks the resonant circuit, thereby causing an electrical open circuit condition which prevents the circuit from resonating. Preferably, the stress exerted on the tag is from normal wear and use of the article during the useful life of the article to which the tag is affixed.

The present invention further provides, in an electronic article surveillance system, a method of deactivating a security tag affixed to an article to be protected. The tag comprises a dielectric substrate having a resonant circuit thereon, wherein the resonant circuit resonates within a predetermined detection frequency range when exposed to an electromagnetic field, and stress concentrating means for deactivating the resonant circuit. The method comprises the steps of affixing the tag to an article to be protected and exerting a stress on the protected article through normal usage of the article during the life cycle of the article. The stress breaks the resonant circuit proximate the stress concentrating means such that the resonant circuit is deactivated by creating an electrical open circuit condition.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred, it being understood, however, that the invention is not limited to the precise arrangement and instrumentalities disclosed. In the drawings.

DETAILED DESCRIPTION OF PREFERRED EMBODIMENTS

Figure 1:
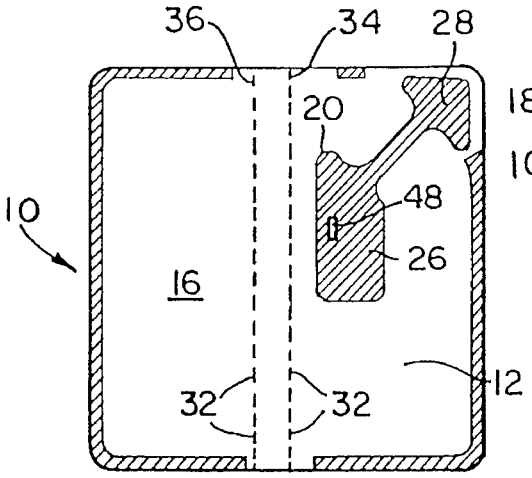
FIG. 1 is an enlarged plan view of one side of a printed circuit security tag in accordance with a preferred embodiment of the present invention.

Certain terminology is used in the following description for convenience only and is not limiting. The words "top", "bottom" "lower" and "upper" designate directions in the drawings to which reference is made. The term "use" or "normal use", when used in reference to an article or product having a tag embedded therein, refers to the usage of the article or product over the life of the product. That is, all care and usage of the product from the time the product is purchased until the product is discarded. The terminology includes the words above specifically mentioned, derivatives thereof and words of similar import.

The present invention is directed to a security tag for use with an electronic security system (not shown) having means for detecting the presence of a security tag within a surveilled area utilizing electromagnetic energy at a frequency within a predetermined detection frequency range. The security tag includes a mechanical stress concentration means for disabling at least one resonant circuit on the tag so that the tag no longer resonates, by focusing stresses exerted on the tag to break the resonant circuit, thereby causing an electrical open circuit condition. Preferably, as described in more detail below, the stresses exerted on the tag are from normal usage of the article to which the tag is affixed. By normal usage of the article, it is meant the everyday or ordinary use of the article over the life of the article, and the stresses exerted on the article therefrom. For instance, for an article of clothing, normal usage comprises wearing and caring for the clothing, including washing, drying and/or ironing.

Figure 2:
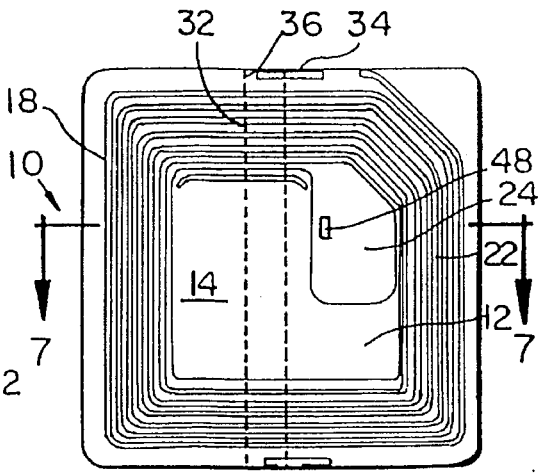
FIG. 2 is an enlarged plan view of an opposite side of the security tag shown in FIG. 1.

Referring now to the drawings, wherein the same reference numeral designations are applied to corresponding elements throughout the several figures, there is shown in FIGS. 1 and 2 a preferred embodiment of a security tag or tag 10 in accordance with the present invention. With certain exceptions hereinafter described, the tag 10 is generally of a type which is well known in the art of electronic article security systems. As is also well known in the art, the tag 10 is adapted to be secured or otherwise borne by an article or retail item, or the packaging of such article for which security or surveillance is sought. The tag 10 may be secured to the article or its packaging at a retail or other such facility, or as is presently preferred, secured or incorporated into the article or its packaging, by the manufacturer or wholesaler of the article.

The tag 10 is employed in connection with an electronic article security system (not shown), particularly an electronic article security system of the radio frequency or RF type. Such electronic article security systems are well known in the art and, therefore, a complete description of the structure and operation of such electronic article security systems is not necessary for an understanding of the present invention. Suffice it to say that such electronic article security systems establish a surveilled area or zone, generally proximate to an entrance or exit of a facility, such as a retail store. The security system's function is to detect the presence within the surveilled zone of an article having an active security tag secured thereto or secured to the corresponding packaging.

In the case of the present embodiment, the security tag 10 includes components, hereinafter described in greater detail, which establish a resonant circuit that resonates when exposed to electromagnetic energy at or near a predetermined detection resonant frequency. A typical electronic article security system employing the tag 10 includes means for transmitting into or through the surveillance zone electromagnetic energy at or near the resonant frequency of the security tag 10 and means for detecting a field disturbance that the presence of an active security tag resonating circuit causes to establish the presence of a security tag 10, and thus a protected article, within the surveillance zone.

In its preferred embodiment, the tag 10 comprises a generally square, planar insulative or dielectric substrate 12 having a first side or surface 14 (FIG. 2) and a second side or surface 16 (FIG. 1). The substrate material may be any solid material or composite structure of materials so long as it is insulative and can be used as a dielectric. Preferably the substrate 12 is formed of an insulated dielectric material of a type well known in the art, for example, a polymeric material such as polyethylene. However, it will be recognized by those skilled in the art that other dielectric materials may alternatively be employed in forming the substrate 12.

The tag further comprises circuitry means located on the substrate 12 for establishing at least one resonant circuit by forming predetermined circuit elements or components. The circuit elements and components are formed on both principal surfaces of the substrate 12 by patterning conductive material. A first conductive pattern 18 is imposed on the first side or surface 14 of the substrate 12 (FIG. 2), which surface is arbitrarily selected as the top surface of the tag 10, and a second conductive pattern 20 is imposed on the opposite or second side or surface 16 of the substrate 12 (FIG. 1), sometimes referred to as the back or bottom surface. The conductive patterns 18, 20 may be formed on the substrate surfaces 14, 16, respectively, with electrically conductive materials of a known type and in a manner which is well known in the electronic article surveillance art. The conductive material is preferably patterned by a subtractive process (i.e. etching), whereby unwanted material is removed by chemical attack after desired material has been protected, typically with a printed on etch resistant ink. In the preferred embodiment, the conductive material is aluminum. However, other conductive materials (e.g., gold, nickel, copper, phosphor bronzes, brasses, solders, high density graphite or silver-filled conductive epoxies) can be substituted for aluminum without changing the nature of the resonant circuit or its operation.

The tag 10 may be manufactured by processes described in U.S. Pat. No. 3,913,219 entitled "Planar Circuit Fabrication Process", which is incorporated herein by reference. However other manufacturing processes can be used, and nearly any method or process of manufacturing circuit boards could be used to make the tag 10.

Figure 3:
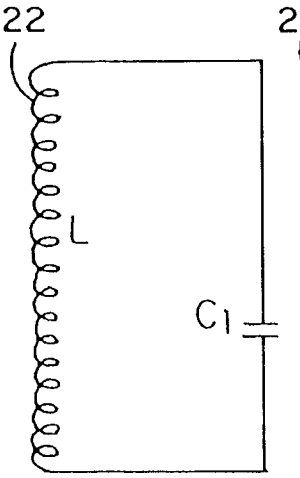
FIG. 3 is an electrical schematic of a resonant circuit used in a preferred embodiment of a security tag of the present invention.

The first and second conductive patterns 18, 20 establish at least one resonant circuit having a resonant frequency within the predetermined detection frequency range of an electronic article surveillance system used with the security tag 10. Referring now to FIG. 3, in a preferred embodiment, the resonant circuit is formed by the combination of a single inductive element, inductor, or coil L electrically connected with a single capacitive element or capacitance $C_1$ in a series loop, as shown and described in U.S. Pat. No. 5,276,431, which is hereby incorporated by reference. The inductive element L is formed by a coil portion 22 of the first conductive pattern 18 and the capacitive element $C_1$ is comprised of a first plate formed by a generally rectangular land portion 24 of the first conductive pattern 18 and a second plate formed by a corresponding, aligned generally rectangular land portion 26 of the second conductive pattern 20. The conductive land portions 24, 26 are separated by the substrate 12 to form the capacitor element $C_1$.

The inductive element L is formed as a spiral coil 22 of conductive material on the first primary surface 14 of the substrate 12. The first plate of the capacitor element $C_1$, conductive land portion 24 is electrically connected to one end of the inductor coil 22. Similarly, the second plate of the capacitor element $C_1$, conductive land portion 26, is electrically connected by a weld connection (not shown) extending through the substrate proximate a land extension 28 on the second side 16 to the other end of the inductor coil portion 22, thereby connecting the inductive element L to the capacitor element $C_1$ in series in a well known manner.

Although the tag 10 includes a single inductive element L and a single capacitor element $C_1$, multiple inductor and capacitor elements could alternatively be employed. For instance, multiple element resonant circuits are well known in the electronic security and surveillance art. The construction of these resonant circuits can be altered through the use of remote electronic devices. Such circuit alteration may occur, for example, at a manufacturing facility or at a checkout counter when a person purchases an article with an affixed or embedded security tag 10, depending upon the intended use of the tag 10. Deactivation of the tag 10, which typically occurs at the point of sale, prevents the resonant circuit from resonating so that the electronic security system no longer detects when the article passes through the surveillance zone of the electronic security system. Frequency shifting, which typically occurs at the manufacturing facility, changes the frequency at which the resonant circuit resonates.

Figure 4:
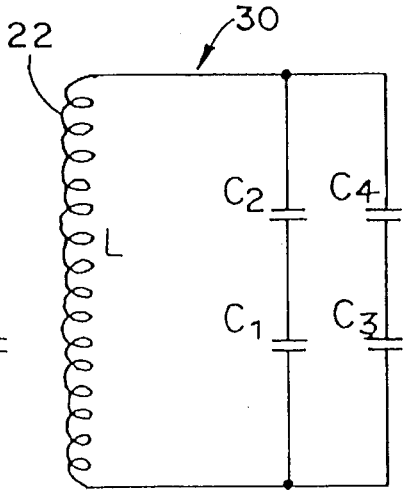
FIG. 4 is an electrical schematic of an alternate embodiment of a resonant circuit used in a security tag in an initial condition in accordance with the present invention.
Figure 5:
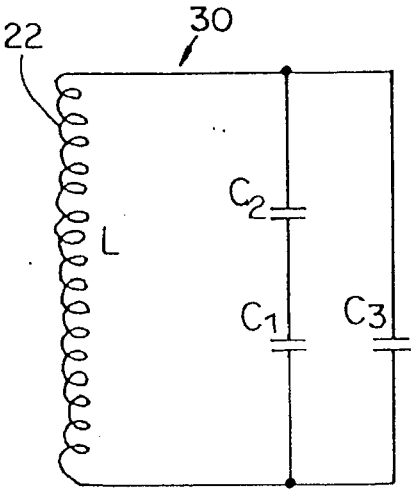
FIG. 5 is an electrical schematic of the resonant circuit shown in FIG. 4 with a first capacitor short-circuited.

FIG. 4 shows an electrical schematic of an alternate embodiment of a resonant circuit 30 used in a security tag 10 in an initial condition in accordance with the present invention. The circuit 30 includes an inductor L electrically connected in parallel with series connected capacitive elements $C_1$ and $C_2$ and series connected capacitive elements $C_3$ and $C_4$, as disclosed in U.S. Pat. No. 5,103,210, assigned to Checkpoint Systems, Inc., which is hereby incorporated by reference. This circuit configuration is used in tags which resonate within an initial frequency range outside of the predetermined detection frequency range. The circuit 30 may be altered, as shown in FIG. 5, at a later time, to an active state, such that the circuit 30 resonates within the predetermined detection frequency range by short-circuiting the capacitor $C_3$ and thus eliminating it from the circuit 30. The circuit 30 may also be deactivated by short-circuiting another capacitor (e.g. $C_2$) so that the circuit 30 no longer resonates within the predetermined detection frequency range. Various other methods have been developed for deactivating security tags. Some methods require determining the location of the security tag in the secured article and physical intervention, such as physically removing the security tag or covering the tag with a shielding or detuning device such as a metallized sticker. Other methods involve exposing the tag to higher energy levels to cause the creation of a short circuit or open circuit within the tag, thereby modifying the tag circuit's topology and altering its resonance characteristics. A short or open circuit is usually created through the use of a weak link designed to reliably change in a predictable manner upon exposure to sufficient energy.

The tag 10 and its alternate embodiments as thus far described are typical of security tags which are well known in the electronic security and surveillance art and have been in general usage. In forming such security tags, the area of the coil 22 and the areas and overlap of the capacitor plates 24, 26 are carefully selected so that the resonant circuit formed thereby has a predetermined resonant frequency which generally corresponds to or approximates a detection frequency employed in an electronic article security system for which the tag 10 is designed to be employed. In the presently preferred embodiment, the tag 10 resonates at or near 8.2 megaHertz, which is one commonly employed frequency used by electronic security systems from a number of manufacturers. However, this specific frequency is not to be considered a limitation of the present invention.

The present invention provides a means for deactivating the resonant circuit of the tag 10 by providing a stress concentrating means for concentrating a mechanical stress exerted on the tag 10 to a predetermined area of the tag 10 proximate to at least a portion of the at least one resonant circuit. The mechanical stress disables the at least one resonant circuit. The stress concentrating means allows for a mechanical stress exerted on the tag 10 to break or fracture a conductor of the at least one resonant circuit, thereby causing an electrical open circuit condition which prevents the resonant circuit from resonating.

In the presently preferred embodiment, shown in FIG. 1, the stress concentrating means for disabling the at least one resonant circuit comprises a series of perforations 32 extending along a line across the substrate 12. The line of perforations 32 crosses at least a portion of the resonant circuit formed on the substrate surfaces 14, 16. In FIG. 1, a first perforation path 34 is formed by a line of the perforations 32. The perforation path 34 comprises a series of spaced apart perforations 32 extending along a line across the substrate 12, with the perforations 32 extending through at least a portion of the resonant circuit. Thus, a stress exerted on the tag 10 breaks the resonant circuit along the first perforation path 34, causing an electrical open circuit condition. The open circuit condition prevents the resonant circuit from resonating. Each perforation 32 provides a physical weak point on the tag 10 such that a stress or force exerted on the tag 10 is concentrated at the perforation 32. By providing a series of perforations 32 or a perforation path 34, stress exerted on the tag 10 severs, tears, or otherwise breaks the resonant circuit on the tag 10 along or proximate to the perforation path 34. Once the tag 10 is stressed, such as by tearing, stretching, pulling, twisting, or flexing, the stress is concentrated along the perforation path 34, which causes the resonant circuit to break in at least one, but preferably along a plurality of places, thus ensuring that the resonant circuit no longer resonates.

The security tag 10 may also include a second perforation path, indicated as 36. The second perforation path 36 may be located so that it is substantially parallel to and spaced from the first perforation path 34. Providing two perforation paths may further concentrate stresses applied to the tag 10. In the presently preferred embodiment, the inductor L is generally spiral shaped, like coil portion 22 shown in FIG. 2. It will be appreciated by those skilled in the art that the actual shape of the coil portion 22 may be varied so long as appropriate inductive elements and values are provided to allow the circuit to resonate within the predetermined resonant frequency when activated. If the coil portion 22 is spiral shaped, a plane which intersects the substrate 12 at opposite edges thereof intersects the coil portion 22 at a plurality of spaced points. It is preferred that at least one of the perforations 32 passes through at least one of the spaced points to ensure that the inductor L is broken (i.e. an open circuit condition) when stress is exerted on the tag 10. It is further preferred that each of the plurality of spaced points includes at least one perforation therein, so that the inductor coil 22 is broken at one or more points. The perforation 32 is sized such that the perforation 32 is smaller than the width of the coil portion 22 so that the perforation 32 cannot by itself break the coil portion 22. In one embodiment of the tag 10, the coil lines of the coil portion 22 are approximately 0.04 inches wide and are spaced apart by approximately 0.015 inches, and the perforations 32 are less than 0.04 inches long, and preferably approximately 0.02 inches long. Such sizing ensures that the perforations contact the individual coils of the coil portion 22 but that a perforation 32 is not large enough to break an individual coil.

In addition, the perforations 32 in the first perforation path 34 may be offset or in staggered relation to the perforations in the second perforation path 36. Locating the perforations 32 of the perforation paths 34, 36 in staggered relation to each other ensures that each coil line of the inductor 22 includes at least one perforation 32. It will be understood that variations on the perforation paths 34, 36 may be substituted for the paths shown in FIGS. 1 and 2. For instance, although the perforation paths 34, 36 are shown in spaced, parallel relation to each other, it will be understood that if more than one perforation path is provided, that the paths need not be in parallel relation to each other. For example, if two perforation paths are provided, the paths could be oriented perpendicular to each other or at some other angle between perpendicular and parallel. In addition, although the paths 34, 36 are shown extending from one edge of the substrate 12 to an opposite edge, in a straight line, the paths 34, 36, could extend diagonally across the substrate 12 from adjacent edges of the substrate 12. Alternatively, the paths 34, 36, need not extend completely across the substrate 12. Suffice it to say that a great many variations in laying out one or more perforation paths across the substrate 12 are possible, and that the present invention is not meant to be limited to only those variations shown.

Figure 6A:
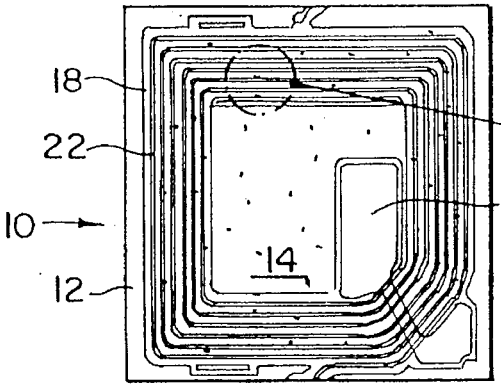
FIG. 6A is an enlarged plan view of one side of a printed circuit security tag in accordance with a first alternate embodiment of the present invention.
Figure 6B:
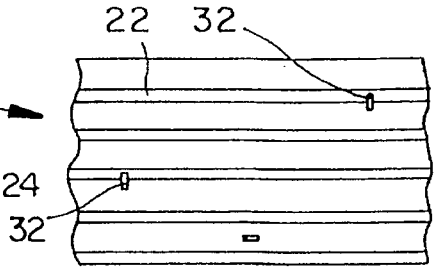
FIG. 6B is a greatly enlarged view of a portion of the security tag shown in FIG. 6A.

FIGS. 6A and 6B show an alternate embodiment of the stress concentrating means for disabling the resonant circuit is shown. In this embodiment, the stress concentrating means comprises a plurality of perforations which are randomly located in the substrate 12. As indicated in FIG. 6B, some of the perforations may intersect portions of the inductive element 22 and some may not intersect the inductive element 22. However, the purpose of the perforations 32 is still to provide focal points for stress exerted on the tag sufficient to cause the resonant circuit on the tag 10 to break or fracture.

Figure 7:
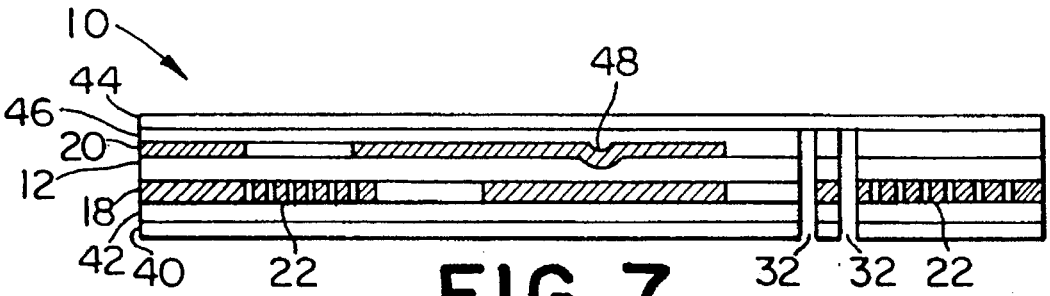
FIG. 7 is diagrammatic cross-sectional view of a security tag taken along line 7—7 in FIG. 2.

FIG. 7 shows a cross sectional view of the tag 10, including substrate 12 having first and second conductive patterns 18, 20 on the first and second sides 14, 16, respectively, with the first conductive pattern 18 including coil portion 22. The tag 10 further comprises a paper face sheet 40 affixed to the substrate first side 14 with an adhesive layer 42 and a paper backing layer 44 affixed to the substrate second side 16 with an adhesive layer 46. Preferably, each perforation 32 extends through the paper face sheet 40 and substantially through the substrate 12, including portions of each of the conductive patterns 18, 20 thereon. The stress concentrating means may be etched on the tag 10 or, if the stress concentrating means comprise perforations 32, as is presently preferred, the perforations 32 are cut using a mechanical perforating tool. However, it will be apparent to those of ordinary skill in the art that other means of creating a stress concentrating means on the tag 10 may be used, such as cutting a pattern of holes in the tag 10 with a laser.

Figure 8:
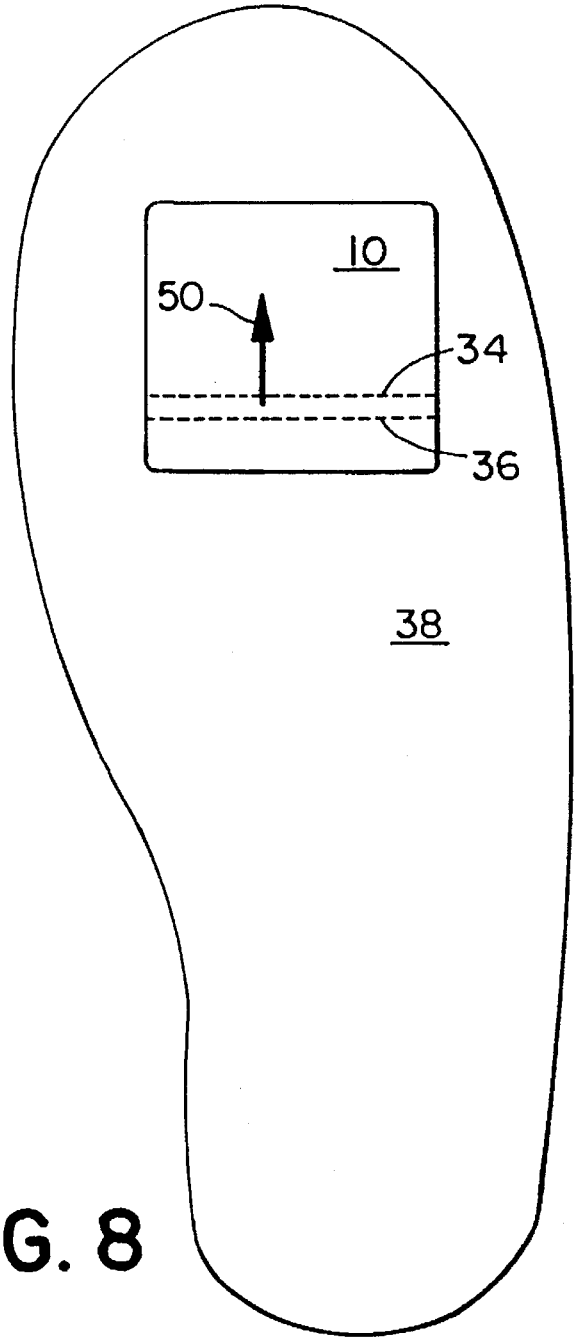
FIG. 8 is a top plan view of a security tag in accordance with the present invention affixed to an article to be protected by an electronic article surveillance system.

Referring now to FIG. 8, in its preferred embodiment, the tag 10 may be embedded within an article to be protected, such as a pair of shoes, by a manufacturer prior to shipment of the article to a retail establishment. For instance, the tag 10 may be embedded between an inner sock and an inner sole of a shoe 38. Upon purchase of the shoe 38, the tag 10 may be electrically deactivated at a point of sale, in a manner known in the art, such as by short circuiting a capacitor of the resonant circuit. Then, normal wear and use of the shoe 38 exerts stress on the tag 10 embedded therein, causing the tag 10 to tear, break, or shear along the perforation path 34. Such stress causes an electrical open circuit condition which prevents the tag 10 from resonating. In the event that the store does not have an electronic deactivator device, then the shoe, through normal wear and usage, will exert stress on the tag 10 embedded therein, for the life of the shoe. It is presently preferred that if the tag 10 is used with shoes, that the tag 10 be located proximate to the ball of the foot and with the perforation paths 34, 36 extending perpendicular to the shoe (as shown in FIG. 8) in order to maximize the stress exerted on the tag 10 through the use of the shoe. A mark, such as an arrow 50 may be printed on the face of the tag 10 which is perpendicular to the perforation paths 34, 36 to facilitate orienting and positioning the tag 10 on the shoe. Of course, it will be understood that the tag 10 may be used in conjunction with other articles, such as clothing. If the tag 10 is used with clothing, normal use of the clothing, such as washing, drying and wearing of the clothing exerts sufficient stress on the tag 10 to break the resonant circuit and allow the tag 10 to be disabled.

As previously discussed in relation to FIGS. 4 and 5, and as shown in FIG. 7, the tag 10 may also include means for deactivating the tag 10, such as a means for short circuiting a capacitor of the resonant circuit such that the circuit is either nonresonant or resonates at a frequency outside of the predetermined detection frequency. A dimple or indentation 48 may be formed in one or more of the capacitive elements of the resonant circuit for facilitating short circuiting the capacitors through the application of high frequency electromagnetic energy. As is apparent, the dimple 48 differs from the stress concentrating means or perforations 32 in that the dimple 48 is provided in one plate of a capacitor to decrease the thickness of the substrate 12, and thus the distance between the conductive patterns 18, 20 of the capacitor to facilitate a means for providing an electrical short circuit upon the application of high power electromagnetic energy. In contrast, the perforations 32 extend substantially through the substrate 12 and the conductive patterns 18, 20, and provide a weak point or spot in the tag 10 to facilitate creating an electrical open circuit condition when a stress is applied to the tag 10. In addition, the perforations 32 or stress concentrating means are positioned to break the resonant circuit, preferably at the coil portion 22, as opposed to the dimple 48, which is positioned on one plate of a capacitor. However, although a dimple 48 is structurally different from a perforation 32, it will be apparent to those of ordinary skill in the art that a plurality of dimples appropriately positioned on the tag 10 could serve as a stress concentrating means. Accordingly, the stress concentrating means includes, in addition to one or more perforations, other means for concentrating stress sufficient to cause an electrical open circuit condition, such as a series of appropriately positioned or aligned dimples.

From the foregoing description, it can be seen that the present embodiment comprises a surface deactivateable security tag for use with an electronic security system. It will be recognized by those skilled in the art that changes may be made to the above-described embodiment of the invention without departing from the broad inventive concepts thereof. It is understood, therefore, that this invention is not limited to the particular embodiment disclosed, but is intended to cover any modifications which are within the scope and spirit of the invention as defined by the appended claims.

We claim:

1. A security tag for use with an electronic security system, the security system having means for detecting the presence of a security tag within a surveilled area utilizing electromagnetic energy at a frequency within a predetermined detection frequency range, the security tag comprising:

a dielectric substrate having first and second opposite principal surfaces;

a resonant circuit capable of resonating at a frequency within the predetermined detection frequency range, the resonant circuit including an inductor formed at least in part on one of the principal surfaces of the substrate; and a first perforation path comprising a series of spaced apart perforations extending along a line across the substrate, the line extending through at least a portion of the resonant circuit, wherein a stress exerted on the tag breaks the resonant circuit along the first perforation path thereby causing an electrical open circuit condition which prevents the resonant circuit from resonating.

2. The security tag as recited in claim 1 wherein the tag is affixed to an article and the stress is applied to the tag as a result of use of the article.

3. The security tag as recited in claim 1 wherein each perforation extends substantially through the substrate.

4. The security tag of claim 1 further comprising means for short circuiting a capacitor of the resonant circuit such that the circuit is nonresonant.

5. The security tag of claim 1 wherein the resonant circuit comprises etched aluminum foil on each principal surface of the substrate.

6. The security tag as recited in claim 1 wherein the inductor is generally spiral shaped such that a plane which intersects the substrate at opposite edges thereof intersects the spiral at a plurality of spaced points, and wherein at least one of said perforations passes through at least one of said spaced points.

7. The security tag as recited in claim 6 wherein each of said plurality of spaced points includes at least one perforation therein.

8. The security tag as recited in claim 1 further comprising a second perforation path.

9. The security tag as recited in claim 8 wherein the second perforation path is substantially parallel to and spaced from the first perforation path.

10. The security tag as recited in claim 9 wherein the first and second perforation paths are in staggered relation such that the perforations in the first perforation path are offset from the perforations in the second perforation path.

11. A security tag for use with an electronic security system having means for detecting the presence of a security tag within a surveilled area utilizing electromagnetic energy at a frequency within a predetermined detection frequency range, the security tag comprising:

a dielectric substrate having first and second opposing principal surfaces;

at least one resonant circuit disposed on said substrate capable of resonating at a frequency within the predetermined detection frequency range; and stress concentrating means for concentrating a mechanical stress exerted on the tag to a predetermined area of the tag proximate to at least a portion of the at least one resonant circuit for disabling the at least one resonant circuit, whereby a mechanical stress exerted on the tag breaks the at least one resonant circuit, thereby causing an electrical open circuit condition which prevents the circuit from resonating.

12. The security tag of claim 11 wherein the stress concentrating means for disabling the at least one resonant circuit comprises a series of perforations extending along a line across the substrate, the line crossing at least a portion of the at least one resonant circuit.

13. The security tag of claim 11 wherein the stress concentrating means for disabling the at least one resonant circuit comprises a plurality of perforations randomly located in the substrate.

14. In an electronic article surveillance system, a method of deactivating a security tag affixed to an article to be protected, the security tag comprising a dielectric substrate having a resonant circuit thereon, wherein the resonant circuit resonates within a predetermined detection frequency range when exposed to an electromagnetic field, and stress concentrating means for deactivating the resonant circuit, the method comprising the steps of:

affixing the security tag to an article to be protected; and exerting a stress on the protected article through usage of the article, the stress breaking the resonant circuit proximate the stress concentrating means whereby the resonant circuit is deactivated by creating an electrical open circuit condition.

15. The method of claim 14 wherein the tag includes means for changing the resonant frequency of the resonant circuit so that the circuit resonates within a second frequency range outside of the predetermined detection frequency range, further comprising the step of:

prior to exerting the stress on the protected article, short-circuiting a capacitor of the resonant circuit so that the circuit is nonresonant.

16. The method of claim 14 wherein the tag includes means for changing the resonant frequency of the resonant circuit so that the circuit resonates within a second frequency range outside of the predetermined detection frequency range, further comprising the step of:

prior to exerting the stress on the protected article, short-circuiting a capacitor of the resonant circuit so that the circuit resonates outside of the predetermined detection frequency range.

17. A deactivateable security tag for use with an electronic security system, the security system having means for detecting the presence of a security tag within a surveilled area utilizing electromagnetic energy at a frequency within a predetermined detection frequency range, the security tag comprising:

a dielectric substrate having first and second opposite principal surfaces;

a resonant circuit capable of resonating at a frequency within the predetermined detection frequency range, the resonant circuit including an inductor formed at least in part on one of the principal surfaces of the substrate;

means for changing the resonant frequency of the resonant circuit such that the circuit resonates outside of the predetermined detection frequency range; and a first perforation path comprising a series of spaced apart perforations extending along a line across the substrate, the line extending through at least a portion of the inductor, wherein a stress exerted on the tag breaks the inductor along the first perforation path thereby causing an electrical open circuit condition which prevents the resonant circuit from resonating.

* * * * *